US005247758A

United States Patent [19]

Mason

[11] Patent Number: 5,247,758

[45] **Date of Patent: * Sep. 28, 1993**

[54] RIFLE BARREL TRUSS MOUNTING

[76] Inventor: James D. Mason, 6439 Caminito Listo, San Diego, Calif. 92111

[ * ] Notice: The portion of the term of this patent subsequent to Jun. 23, 2009 has been disclaimed.

[21] Appl. No.: 811,804

[22] Filed: Dec. 20, 1991

Related U.S. Application Data

[63] Continuation-in-part of Ser. No. 633,008, Dec. 24, 1990, Pat. No. 5,123,194.

[51] Int. Cl.[5] ..... F41A 21/28

[52] U.S. Cl. ..... 42/75.02; 42/75.03; 89/191.01

[58] Field of Search ..... 42/71.01, 75.01, 75.02, 42/75.03; 89/191.01, 199

[56] References Cited

U.S. PATENT DOCUMENTS

| | | | |
|---|---|---|---|
| 2,597,746 | 5/1952 | Mulno | 42/75.03 |
| 2,679,124 | 5/1954 | Sefried | 42/75.02 |
| 2,685,754 | 8/1954 | Crittendon et al. | 42/75.01 |
| 4,328,633 | 5/1982 | Pachmayr et al. | 42/71.01 |
| 4,430,822 | 2/1984 | Fromming et al. | 42/71.01 |
| 5,123,194 | 6/1992 | Mason | 42/75.02 |

*Primary Examiner*—Stephen C. Bentley

*Attorney, Agent, or Firm*—Brown, Martin, Haller & McClain

[57] ABSTRACT

A mounting structure adaptable to existing rifles and the like for bedding the receiver, action and barrel assembly securely in the stock without elaborate preparation and fitting. A rigid truss structure is formed by a beam secured between the receiver and a post portion on the barrel forward of the receiver which post can be the gas diverting block of a gas operated semi-automatic rifle, the assembly being attached to the stock entirely by the beam. The truss structure transfers the firing and recoil loads directly to the stock and effectively isolates the receiver and forward barrel sections from the associated vibrations.

8 Claims, 4 Drawing Sheets

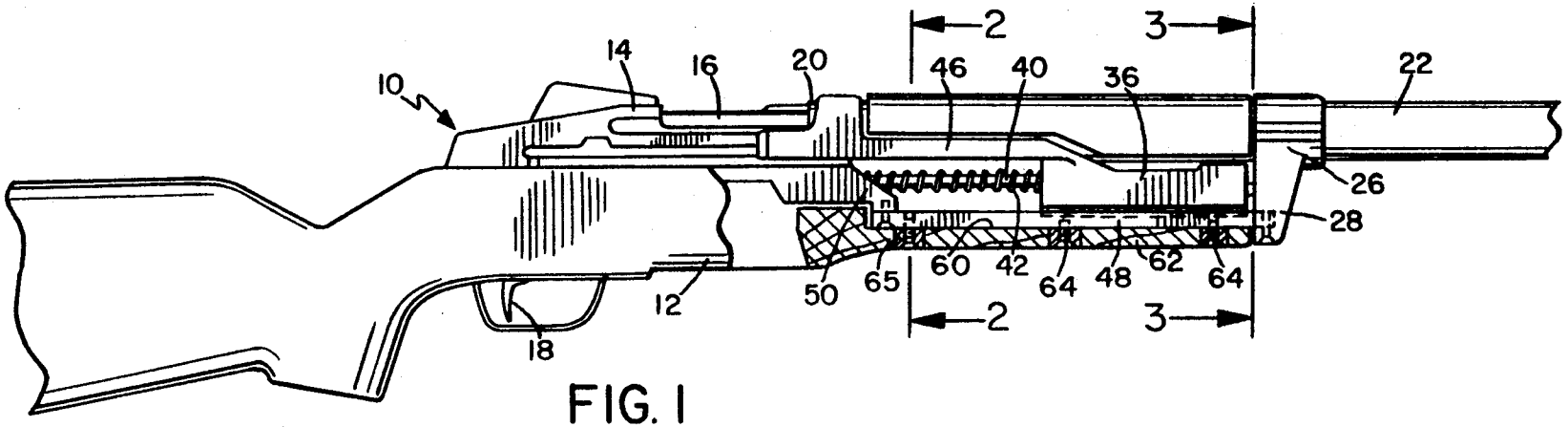
FIG. 1
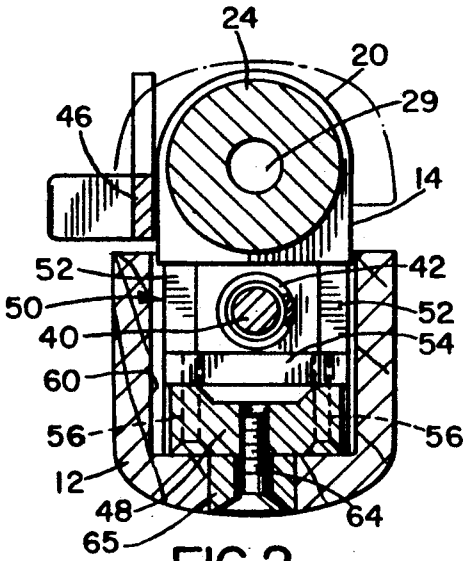
FIG. 3
FIG. 2

66
72
90
68
86
88
84
91
40
54
52
56
70
12
14
76
29
24
20
50
74

92
98
100
96
65
94

RIFLE BARREL TRUSS MOUNTING

This application is a continuation-in-part of application Ser. No. 07/633,008, filed Dec. 24, 1990, now U.S. Pat. No. 5,123,194.

BACKGROUND OF THE INVENTION

In rifles and other long guns the primary structure of the receiver, action, barrel and associated components is usually mounted in a wooden or plastic stock and secured by screws through the stock into one or more spaced apart positions on the metal structure. The assembly is thus supported only at the points of attachment unless the stock is built up or modified to bed the structure closely into the stock. This is usually accomplished by use of resin materials and glass fiber or other reinforcement, with the rifle structure seated in the still wet or pliable material to ensure a close fit, or by careful shaping and machining to fit the parts.

In a gas operated semi-automatic rifle, a portion of the propellant gas is diverted from the barrel after passage of the bullet to drive a slide mechanism rearward, which actuates the bolt to extract the empty casing and load a new round. The slide mechanism is mounted under the barrel and the stock is-cut away to provide operating clearance. This makes it impractical to support the barrel between the receiver and the gas diverting block, the latter usually being one of the mounting points to the stock. With the structure supported only at small specific points, the firing and recoil loads cause transient disturbances that are adverse to consistent barrel motion, contributing to inaccuracy of the aim. This is especially true of lightweight sportier type barrels where complex harmonic motions are induced from gas pulse reactions of the actuator, as well as dynamic interference from inertia block movements. Further, the cantilevered forward barrel section can develop a whipping action which will loosen the supports and cause the rifle to lose its precise sighting alignment.

In normal production of rifles it is not feasible to maintain the precise tolerances necessary for individually bedding the metal assembly. Also, with wood and plastic stocks which are affected by temperature, humidity and other factors, such close tolerances would not be stable. If a secure mounting is essential, as for precision target shooting, custom fitting becomes necessary and this can be time consuming and expensive.

SUMMARY OF THE INVENTION

In the system described herein, the rifle is provided with a rigid truss structure which forms the sole attachment of the metal assembly to the stock. A rigid elongated beam is secured between the receiver frame and a portion of the barrel forward of the receiver. In a gas operated semi-automatic or auto-loading rifle, the forward support can be the gas diverting block projecting downward from the barrel, to carry the gas to a piston and slide mechanism which actuates the bolt. The receiver normally has a bracket or post structure which is one of the attachment points to the stock, the gas block being used as another post or attachment point. The beam is thus secured to the existing mounting points and forms a sturdy rectangular box truss with the mounting structures and the breech end portion of the barrel between the receiver and the forward gas block or support.

The metal structure is then bedded into and secured to the stock over a large interface by means of the rigid beam, which can be of uniform cross section and will seat in an easily cut channel in the stock. The truss structure forms a frame which contains the gas driven reciprocating slide that actuates the bolt. Firing and recoil loads are thus directed into the truss and absorbed into the stock. The receiver need not be bedded into the stock and can thus be isolated from the firing loads, so minimizing the vibration and shock loads on the action and other moving parts. This also minimizes vibration on the rear sights or telescopic sight, which are usually mounted on the receiver. Vibration on the forward cantilevered barrel is also reduced. If the stock is continued forward to provide an extended hand grip, the barrel can be isolated from the stock to prevent vibration transfer.

A primary object of this invention, therefore, is to provide a new and improved barrel to stock mounting system for a rifle or the like.

Another object of this invention is to provide a barrel to stock mounting system having a rigid truss secured to the breech end portion of the barrel, the truss being directly attached to the stock.

Another object of this invention is to provide a barrel to stock mounting system wherein a rigid elongated beam is secured to and between spaced supports on the breech portion of the barrel, the beam providing the means of attachment to the stock.

A further object of this invention is to provide a barrel to stock mounting in which the truss structure substantially encloses the gas operated slide mechanism of a gas operated autoloading rifle.

Other objects and advantages will be apparent in the following detailed description and accompanying drawings, in which:

BRIEF DESCRIPTION OF THE DRAWINGS

FIG. 1 is a side elevation view of a typical gas operated rifle, with portions cut away to reveal the truss structure;

FIG. 2 is an enlarged sectional view taken on line 2—2 of FIG. 1;

FIG. 3 is an enlarged sectional view taken on line 3—3 of FIG. 1;

DESCRIPTION OF THE PREFERRED EMBODIMENT

Figure 4:
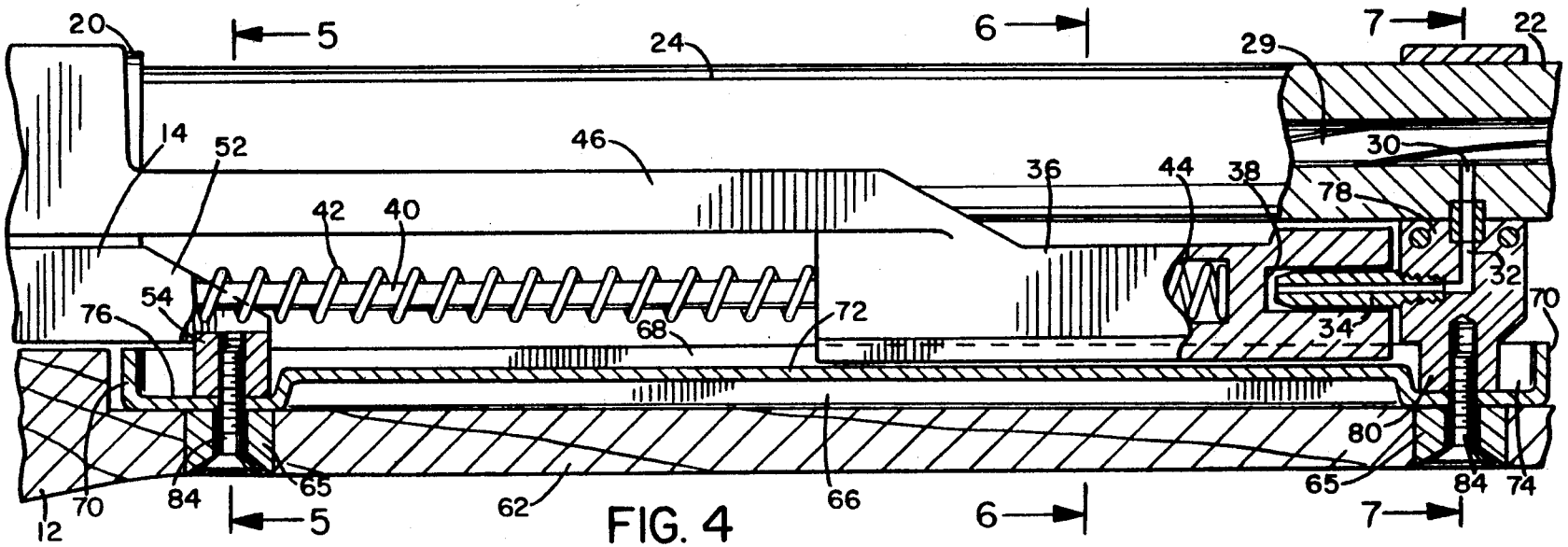
FIG. 4 is an enlarged side elevation view of the truss structure with an alternative beam member, portions being cut
Figure 7:
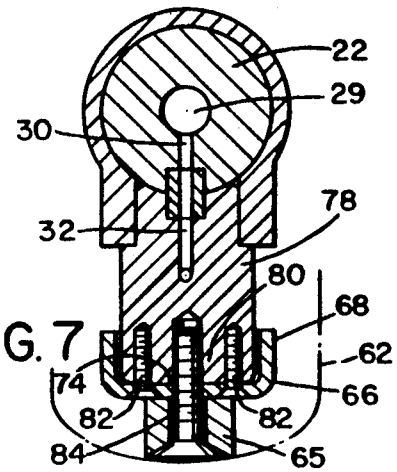
FIG. 7 is a sectional view taken on line 7—7 of FIG. 4.
Figure 6:
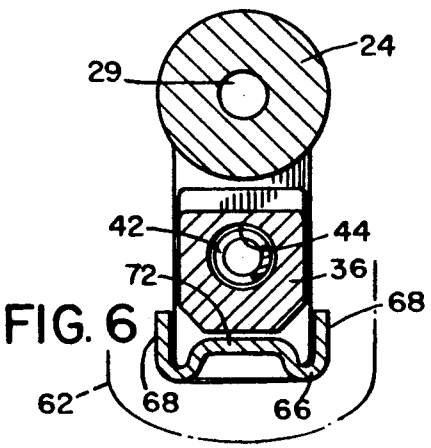
FIG. 6 is a sectional view taken on line 6—6 of FIG. 4.
Figure 5:
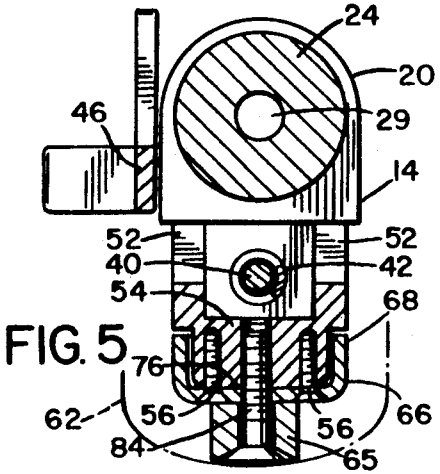
FIG. 5 is a sectional view taken on line 5—5 of FIG. 4.

A typical gas operated rifle 10 is illustrated in FIG. 1, the rifle having a stock 12 which may be of wood, plastic, or other suitable material. The basic rifle structure includes a receiver 14 containing a reciprocating bolt 16 and the associated action and firing mechanism, which is coupled to a trigger 18. The action is conventional and can vary according to the make and caliber of the gun. At the forward end of the receiver is a receiver ring 20 in which the barrel 22 is secured, the breech end portion 24 of the barrel usually being partially enclosed by and supported in the stock.

In the gas operated rifle illustrated, a gas diverting block 26 is secured to the barrel 22 at a point forward of the receiver, the gas block having an extension post 28 extending below the barrel. The bore 29 of barrel 22 has a gas port 30 through which a portion of the propellant gas is diverted into a passage 32 in the gas block 26 to a rearwardly projecting hollow piston 34 fixed in the gas block. The configuration of the gas block and its method of attachment to the barrel can vary.

Mounting below the barrel end portion 24 is a slide 36, having a socket or cylinder 38 which seats over the piston 34. Projecting forwardly from the receiver 14 is a guide rod 40, on which is mounted a recoil spring 42, the spring extending into a deep socket 44 in the rear portion of slide 36. A connecting bar 46 extends rearwardly from slide 36 and is coupled to the bolt 16. In firing the rifle, as a bullet passes along the barrel past port 30, a portion of the propellant gas behind the bullet is blown through the port and through piston 34, causing a sharp pressure pulse in cylinder 38. This drives slide 36 rearward and retracts the bolt 16, which causes the empty case to be ejected. Recoil spring 42 then pushes the slide 36 forward to seat back over piston 34. This closes bolt 16, which has picked up the next round, and reloads the rifle for the next shot.

Thus far the structure is conventional and the action well known. In the usual barrel to stock mounting, the assembly is secured by one or more screws through the stock into a portion of the receiver and by another screw or connection to or adjacent the gas block. This provides spaced supports of small area, with unsupported structure between and on both sides of the points of attachment. The shock of firing causes vibrates throughout the structure, the cantilevered forward barrel in particular having a whipping action. The structure is also subjected to transient, untuned vibration, rather than regular, tuned and predictable barrel motion. While the actual motions are small, the force involved is violent and can cause loosening of the rifle components, which affects the sighting accuracy. The receiver is subjected to the vibration while the action is in motion and friction between contacting parts is increased. Due to the small areas of contact between the metal structure and the stock, very little of the vibration and shock is absorbed by the stock, other than the direct recoil.

To increase the supporting area and minimize vibrations it is usual to bed the metal structure more closely into the stock, by careful shaping or insertion of filler material, or a combination of both. Plastic material such as resin is often used, with fiber reinforcement where needed. The metal structure, suitably protected, is pressed into the soft material and held while the filler sets for optimum fit. Such treatment is time consuming and expensive, since it must be applied on an individual basis. It is not practical to hold such tolerances in normal production.

The truss structure illustrated and described enables rifle components to be securely and accurately bedded on a production basis, in a simple and inexpensive manner. A large contact area is provided and the major portion of the firing shock is absorbed into the stock at the central, rigid portion of the structure, while the extremities are effectively isolated from the shock. The truss provides a damping action and transfers vibration to the stock, effectively isolating disturbances from the barrel and thus stabilizing the cantilevered barrel portion.

With reference to FIGS. 1–3, the truss structure includes an elongated rigid beam 48 secured between receiver 14 and gas block 26, below the barrel. As illustrated, the gas block is the type which forms the front end cap for the stock. The forward end of the beam 48 fits into the lower portion of gas block 26 and is held by a screw 49, as in FIG. 3.

On the forward end of receiver 14 is a yoke 50, comprising a pair of arms 52 supporting a transverse trunnion 54. This, or a comparable structure, is usually on the receiver for attachment to the stock. In the truss structure the beam 48 is secured to the underside of trunnion 54 by screws 56, as in FIG. 2. A rectangular box truss structure is thus formed by the beam 48, receiver 14, barrel portion 24 and the gas block 26.

Beam 48 has a longitudinal shallow channel 58 in the upper surface to serve as a guide for slide 36. Normally the rifle would have an insert in the stock to provide a guide for the slide, but the insert would have no structural connection to the mounting attachments. The stock 12 has a longitudinal channel 60 cut or formed in the forward extension portion 62 to seat the beam 48 closely in the stock, the beam being secured in the stock by suitable screws 64. The screws pass through cylindrical pillars 65 inset in the stock to avoid compression of the stock material. For additional security the beam 48 may be secured in the stock by epoxy resin or other suitable adhesive. It will be obvious that it is much simpler to form the channel 60 of uniform cross section, than the usual elaborately shaped cut out arrangement needed to seat a conventional mounting arrangement. Beam 48 is illustrated as being a solid bar member, but other configurations may be used to suit a particular rifle, or for cost considerations.

The beam 66 shown in FIGS. 4–8 is stamped or pressed from heavy gauge sheet metal and comprises a shallow box element with longitudinal side walls 68 and end walls 70, providing a rigid peripheral flange. The central portion of beam 66 has a raised longitudinal reinforcing rib 72, forming a shallow channel to guide the slide 36, as in FIGS. 4 and 6. Rib 72 does not extend the full length of the beam, but leaves a front recess 74 and a rear recess 76 the full depth of the beam. Rear recess 76 is dimensioned to receive the yoke 50, the beam being secured to trunnion 54 by screws 56. The arrangement is clearly shown in FIG. 8.

In this configuration the gas block 78 is of the type having an extended lower post 80, by which the structure is normally secured into the stock, but is otherwise similar to gas block 26. In the truss arrangement the post 80 fits into front recess 74, the beam being secured to post 80 by screws 82, as in FIG. 7. The truss structure is then secured in stock 12 by screws 84, which are threaded directly into trunnion 54 and post 80 through pillars 65. If necessary an additional screw or screws can be used along the length of the beam. Additional rigidity may be obtained by inserting a reinforcing bar 90 in the underside of stock 12.

Figures 8, 9, 10:
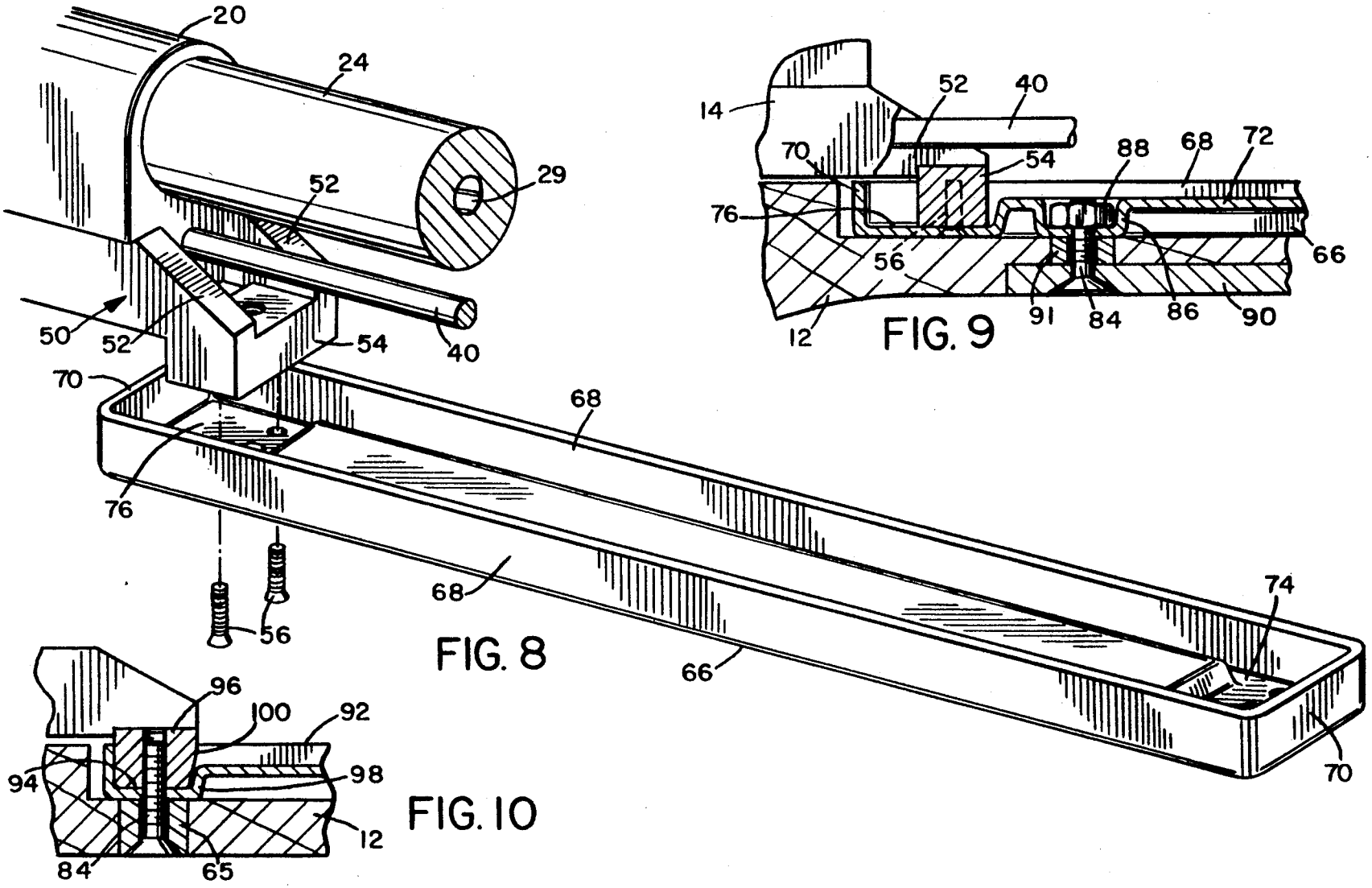
FIG. 8 is a perspective view of a portion of the structure of FIG. 4.
FIG. 9 is a view similar to a portion of FIG. 4, showing an alternative attachment of the beam to the stock.
FIG. 10 is a view similar to a portion of FIG. 4, showing a further beam and trunnion connection.

One arrangement for this attachment is illustrated in FIG. 9, in which rib 72 has a socket 86 to receive a nut 88, which is preferably fixed in place, or may be an anchor nut, for ease of assembly. The beam is then secured to the stock by a screw 84 into nut 88, with pillars 91 between the reinforcing bar 90 and beam 66. Several such screws and nut combinations can be spaced along the beam as needed and epoxy or other adhesive may be used for added security.

In a further configuration illustrated in FIG. 10, the beam 92 has a rear recess 94, similar to that in FIG. 4, but the recess is smaller and is a close fit for trunnion 96. To tighten the joint the forward wall 98 of recess 94 is slightly inclined and the contacting face 100 of trunnion 96 is similarly inclined, to provide a wedging action when screw 84 is tightened. The front end connection may be similarly treated if desired.

Figures 11, 12, 13:
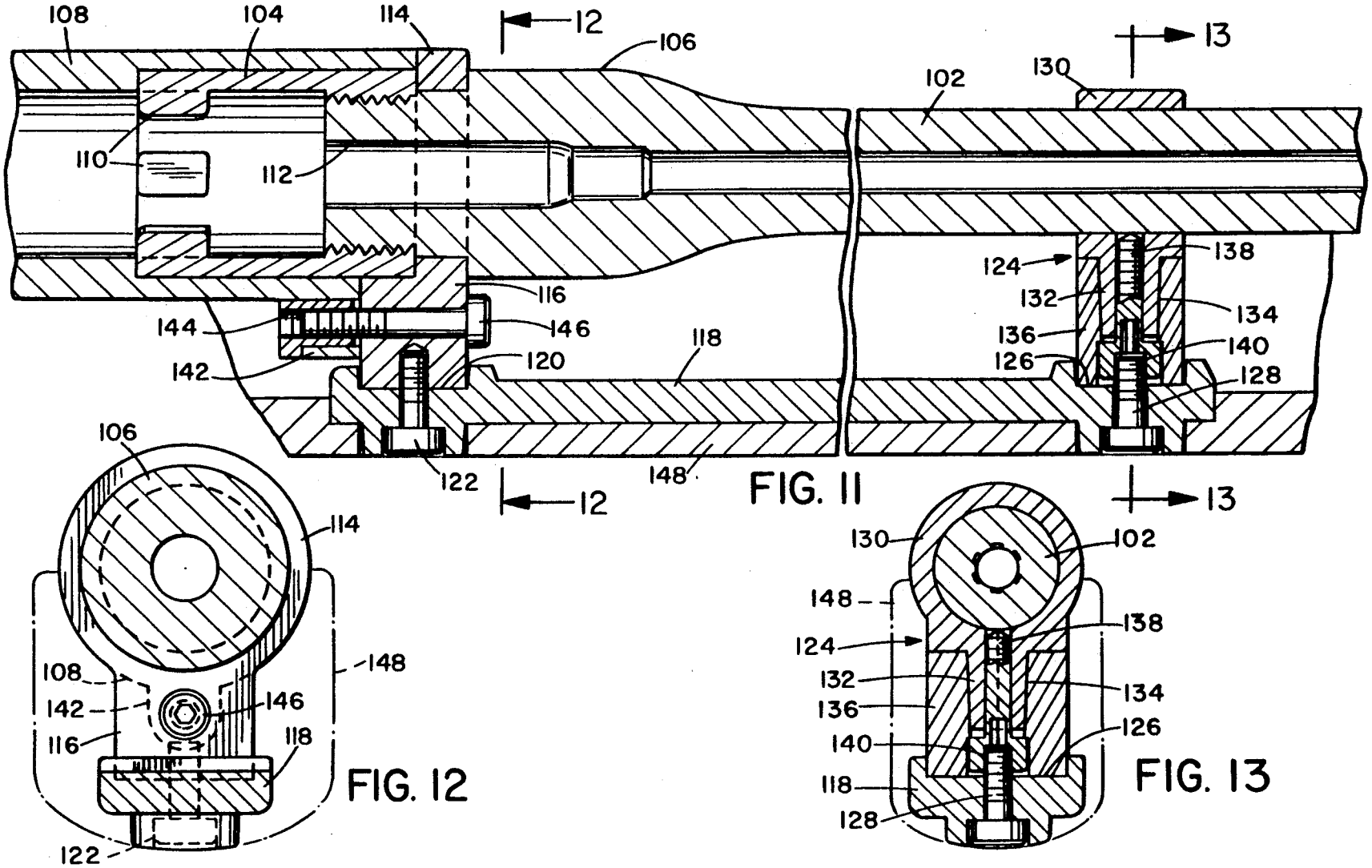
FIG. 11 is a view similar to FIG. 4, showing the beam structure adapted to a bolt action rifle.
FIG. 12 is a sectional view taken on line 12—12 of FIG. 11.
FIG. 13 is a sectional view taken on line 13—13 of FIG. 11.

While the structure has thus far been described for use in a gas operated rifle, the truss is also adaptable to a bolt action rifle to improve stability and accuracy. As illustrated in FIGS. 11–13, the rifle has a barrel 102 with a barrel extension 104 threaded on the breech end 106 Receiver 108 is attached to the barrel extension 104 by various means, depending on the particular rifle. Barrel extension 104 contains locking lugs 110 on which the bolt, not shown, locks into place to hold a cartridge in the chamber 112 for firing. The firing loads are thus contained within the barrel extension and barrel, with minimum stress on the receiver, which can be made of light alloy. The basic structure and action are well known.

In the truss structure as illustrated, a mounting ring 114 is secured between the breech end 106 and barrel extension 104. A post 116 integral with ring 114 extends downwardly and is secured to the rear end of the truss beam 118. As shown the post 116 is seated in a recess 120 in the beam and secured by a screw 122.

Attached to the forward portion of barrel 102 is a forward post 124, which is seated in a recess 126 in the forward end of beam 118 and is secured by a screw 128. The post 124 has a split ring portion 130 which encircles barrel 102, the ring portion having a downwardly extending tapered plug 132, which fits into a correspondingly tapered socket 134 in a lower post block 136. Plug 132 is internally threaded to receive a clamp screw 138 inserted upwardly through block 136. Tightening the clamp screw 138 pulls the plug down into the socket, the taper causing ring portion 130 to be clamped tightly around barrel 102. Clamp screw 138 also bears against the barrel to further lock the ring portion against rotation. Post block 136 is seated in the forward recess 126 and screw 128 is secured in a threaded socket 140 in clamp screw 138. The forward post structure is exemplary and may be varied to suit the particular rifle.

As illustrated, the receiver 108 has a projecting lug 142 in which is a nut 144, the receiver being secured to the post 116 by a retaining screw 146 through the post and into the nut. Other suitable attachment means may be used for specific types of receiver arrangements. The beam 118 may be secured in the stock 148 by any suitable means and provides the desirable rigid support of the barrel for the bolt action type of rifle.

In each instance the rigid beam forming a truss structure with the existing portions of the rifle provides a very rigid support. The major loads occurring during firing are absorbed and vibrations isolated by the truss structure and transferred into the stock. The barrel is not subject to the usual whipping action since the primary structure is so completely supported. This makes it possible, in the design stage of a firearm, to tune the forward barrel portion and position the barrel support block to minimize any movement.

In addition to providing a rigid mounting, the truss structure and its attachment also prevents warping of the forward stock portion, which can cause misalignment and a shifting of the zero sighting of the rifle. The rigid mounting is also concentrated around the center of mass or balance of the firearm, which improves stability.

It should be understood that the structure can be adapted to a variety of rifles, using the existing attachment elements, or by simple addition or modification of support elements for attachment of the beam. The beam itself can also be shaped or formed to fit the specific attachment structure.

The truss is adaptable to gas operated rifles, bolt action, single shot, blow back, or other types of firearms. In instances where there is no gas block, an existing mounting element can be used, or a suitable post or lug can be secured to the barrel at an appropriate location.

Having described my invention, I now claim:

1. In a rifle having a receiver with a cartridge handling action therein, an elongated barrel extending forwardly from the receiver, a gas operated slide reciprocally mounted below said barrel and being connected to said action, a gas diverting block rigidly fixed to and projecting downwardly from the barrel forward of said receiver and coupled to said slide, and a stock in which said receiver and barrel are mounted, the improvement comprising:

a mounting truss including an elongated rigid beam fixedly connected to and between said receiver and said gas block and spaced below said barrel and forming a rigid, generally rectangular truss therewith;

said beam having a longitudinal guide channel for said side;

said receiver having a yoke extending therefrom;

said gas block having a post portion projecting therefrom;

said beam having opposite end portions secured to said yoke ad said post;

said stock having an elongated channel therein to receive said beam;

and fastening means for securing said beam to said stock.

2. The structure according to claim 1, wherein said yoke includes a pair of arms extending forwardly from the receiver, and a transverse trunnion between the arms, said beam being secured to said trunnion.

3. The structure according to claim 1, wherein said beam comprises a channel member having forward and rear recessed portions to receive said post and said yoke, respectively.

4. The structure according to claim 3, wherein said beam has a longitudinal reinforcing rib between said recessed portions.

5. The structure according to claim 1, wherein said fastening means includes screws through said stock into said beam adjacent opposite ends thereof.

6. The structure according to claim 1, wherein said fastening means includes screws through said stock into said beam adjacent opposite ends thereof and at least one intermediate portion of the beam.

7. The structure according to claim 9, wherein said fastening means includes screws through said stock and said beam and into said port and said trunnion.

8. In a rifle having a receiver, an elongated barrel extending forwardly from the receiver, and a stock in which the receiver and barrel are mounted, a mounting truss comprising:

an elongated rigid beam;

a rigid rear post fixed to said barrel at the junction with said receiver;

a rigid forward post fixed to said barrel forwardly of the receiver;

said beam being fixedly connected to and between said rear and forward posts;

said barrel having a breech end portion;

a barrel extension secured on said breech end portion;

said rear post having a ring portion encircling the barrel between said breech end portion and said barrel extension;

said receiver being fixedly secured to said barrel extension and said rear post;

said forward post having a split ring portion surrounding the barrel with a downwardly extending, internally threaded tapered plug, and a lower post portion having a tapered socket to receive said plug;

a clamp screw threaded through said plug for engagement with the barrel to secure the forward post thereto;

said lower post portion being secured to said beam;

and fastening means for securing said beam to said stock.

* * * * *

UNITED STATES PATENT AND TRADEMARK OFFICE

CERTIFICATE OF CORRECTION

PATENT NO. : 5,247,758

DATED : September 28, 1993

INVENTOR(S) : MASON, James D.

It is certified that error appears in the above-indentified patent and that said Letters Patent is hereby corrected as shown below:

Claim 1, column 6, line 45, delete "side" and insert -- slide--.

Claim 1, column 6, line 50, delete "ad" and insert --and--.

Signed and Sealed this

Fifth Day of April, 1994

Bruce Lehman

*Attest:*

BRUCE LEHMAN

*Attesting Officer*

*Commissioner of Patents and Trademarks*